US010610721B2

(12) United States Patent
McCall

(10) Patent No.: US 10,610,721 B2
(45) Date of Patent: Apr. 7, 2020

(54) ADJUSTABLE SLEDGEHAMMER WORKOUT APPARATUS

(71) Applicant: Shannon H. McCall, Laceys Spring, AL (US)

(72) Inventor: Shannon H. McCall, Laceys Spring, AL (US)

( * ) Notice: Subject to any disclaimer, the term of this patent is extended or adjusted under 35 U.S.C. 154(b) by 150 days.

(21) Appl. No.: 15/465,595

(22) Filed: Mar. 21, 2017

(65) Prior Publication Data

US 2017/0266479 A1 Sep. 21, 2017

Related U.S. Application Data

(60) Provisional application No. 62/310,897, filed on Mar. 21, 2016.

(51) Int. Cl.
*A63B 21/072* (2006.01)
*A63B 15/00* (2006.01)
*A63B 21/06* (2006.01)

(52) U.S. Cl.
CPC ..... *A63B 21/0726* (2013.01); *A63B 15/00* (2013.01); *A63B 21/0608* (2013.01); *A63B 21/0722* (2015.10)

(58) Field of Classification Search
CPC ..... A63B 15/00; A63B 21/0004; A63B 21/00058; A63B 21/00061; A63B 21/00065; A63B 21/00069; A63B 21/00072; A63B 21/00185; A63B 21/0608; A63B 21/068; A63B 21/072; A63B 21/0722; A63B 21/0724; A63B 21/0726; A63B 21/0728; A63B 21/075; A63B 21/08; A63B 21/15; A63B 21/159; A63B 21/16; A63B 21/4023; A63B 21/4027; A63B 21/4033; A63B 21/4035; A63B 21/4043; A63B 23/12; A63B 23/1209; A63B 23/1245; A63B 23/1281; A63B 23/129; A63B 65/00; A63B 65/04; A63B 2244/09; A63B 2244/17; Y10T 403/4608;

(Continued)

(56) References Cited

U.S. PATENT DOCUMENTS 4,506,885 A * 3/1985 de Wet ..... A63B 15/00 482/110
4,602,788 A * 7/1986 Wendt ..... A63B 15/00 473/242

(Continued)

OTHER PUBLICATIONS http://www.roguefitness.com:80/strongman/accessories/hammers; one page, Jan. 21, 2016.

(Continued)

*Primary Examiner* — Gary D Urbiel Goldner
(74) *Attorney, Agent, or Firm* — Waller Lansden Dortch & Davis LLP; Blake M. Bernard

(57) ABSTRACT

An adjustable sledgehammer workout apparatus may include a handle, a pair of supporting brackets connected to the handle, and a clamping assembly connected to the supporting brackets. The supporting brackets may be rectangular in shape with beveled or rounded edges. The clamping assembly may include a pair of lower c-shaped portions connected to a pair of upper c-shaped portions using a hinge assembly. Different size and weight dumbbells may be connected to the handle using the clamping assembly.

18 Claims, 10 Drawing Sheets

(58) Field of Classification Search
CPC ..... Y10T 403/4611; Y10T 403/4614; Y10T 403/4617
See application file for complete search history.

(56) References Cited

U.S. PATENT DOCUMENTS

| | | | | |
|---|---|---|---|---|
| 5,496,243 | A * | 3/1996 | Allen | A63B 21/0601 482/106 |
| 6,902,517 | B1 * | 6/2005 | Brown | A63B 21/0728 482/106 |
| 8,267,841 | B1 * | 9/2012 | Allison | A63B 21/06 482/106 |
| 8,684,889 | B1 * | 4/2014 | Berrisford | A63B 21/4035 482/107 |
| 2009/0152783 | A1 * | 6/2009 | Sigler | E04H 17/26 269/6 |
| 2011/0177922 | A1 * | 7/2011 | Selinger | A63B 21/0724 482/107 |
| 2012/0149539 | A1 * | 6/2012 | Quader | A63B 21/08 482/109 |
| 2012/0252641 | A1 * | 10/2012 | Odneal | A63B 21/072 482/108 |
| 2013/0244842 | A1 * | 9/2013 | Henley | A63B 21/0726 482/106 |
| 2014/0018214 | A1 * | 1/2014 | Jordan | A63B 21/072 482/107 |
| 2014/0024506 | A1 * | 1/2014 | Vixathep | A63B 21/0726 482/108 |
| 2014/0051554 | A1 * | 2/2014 | Walker | A63B 15/00 482/109 |
| 2014/0135186 | A1 * | 5/2014 | Reynolds | A63B 21/0726 482/108 |
| 2015/0105224 | A1 * | 4/2015 | Odneal | A63B 21/0726 482/107 |
| 2016/0096057 | A1 * | 4/2016 | Gavigan | A63B 65/04 482/109 |
| 2017/0095687 | A1 * | 4/2017 | Sonnon | A63B 21/0722 |

OTHER PUBLICATIONS http://www.roguefitness.com:80/sisu-war-hammer; three pages, Jan. 21, 2016.
http://www.roguefitness.com:80/slater-slammer; four pages, Jan. 21, 2016.
http://www.roguefitness.com:80/kabuki-strength-shoulderok; four pages, Jan. 21, 2016.

* cited by examiner

ADJUSTABLE SLEDGEHAMMER WORKOUT APPARATUS

CROSS-REFERENCES TO RELATED APPLICATIONS

The present application is a nonprovisional of U.S. provisional patent application Ser. No. 62/310,897, filed on Mar. 21, 2016 and titled "Adjustable Sledgehammer Workout Apparatus." The present application claims priority on, and incorporates by reference in its entirety, the '897 application.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to workout equipment. More particularly, the present disclosure relates to an adjustable sledgehammer workout apparatus.

Sledgehammer workouts are well known in the art and generally involve an individual swinging and striking a rubber tire with a sledgehammer. Sledgehammers for this purpose are available in a variety of weights and individuals must purchase different weighted sledgehammers in order to vary the weight they are using during a workout. Purchasing multiple different weighted sledgehammers, however, can be expensive and undesirable in some cases. In addition, storing multiple different weighted sledgehammers can be inconvenient for some individuals.

BRIEF SUMMARY

The present invention is directed to an adjustable sledgehammer workout apparatus that can be used by an individual to create a sledgehammer and to vary the weight of that sledgehammer as desired. As a result, individuals do not need to purchase and store multiple different weighted sledgehammers.

In one exemplary embodiment, the adjustable sledgehammer workout apparatus of the present invention includes a handle having a clamping assembly connected to one end. The clamping assembly can be used to connect any one of a variety of different size and weight dumbbells to the handle. The handle may be a steel pipe and the diameter and length of the handle may vary from one embodiment to another. The clamping assembly may include a pair of annular clamps, an upper brace connected between upper portions of the annular clamps, and a pair of lower spacers connected to lower portions of the annular clamps and one end of the handle. Each annular clamp may include a hinged portion, which allows each annular clamp to open to form two c-shaped portions, and a tightening fastener that can be used to secure the two c-shaped portions of the annular clamp together.

Numerous other objects, advantages and features of the present disclosure will be readily apparent to those of skill in the art upon a review of the following drawings and description of a preferred embodiment.

DETAILED DESCRIPTION

Figure 2:
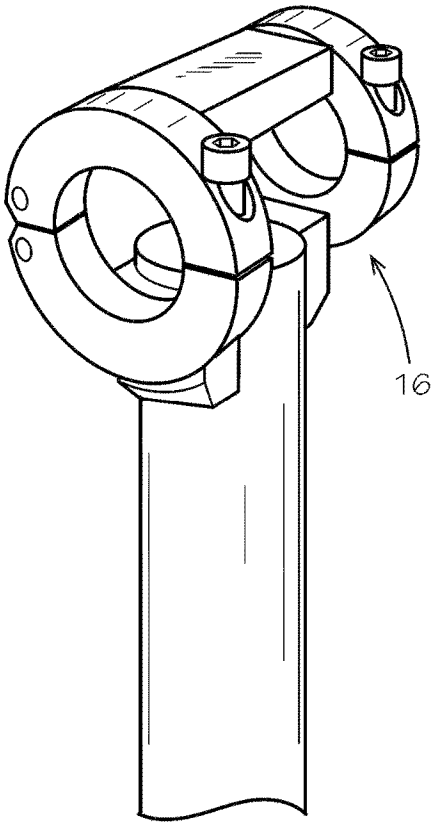
FIGS. 1-6 are perspective views showing one embodiment of the present invention.
Figure 1:
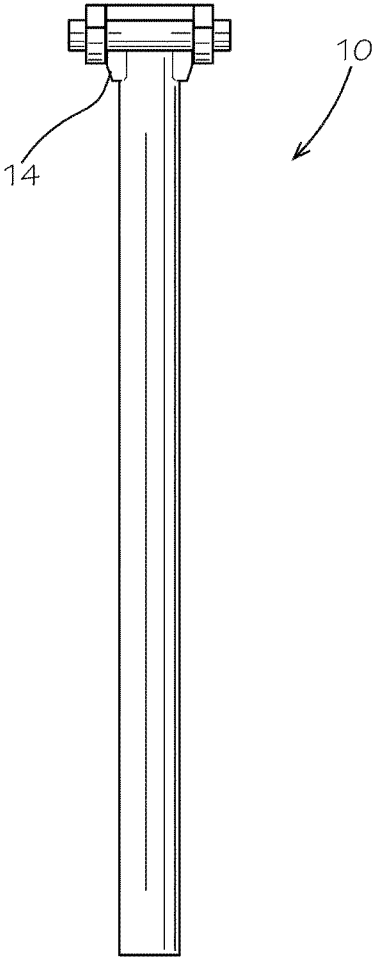

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 4:
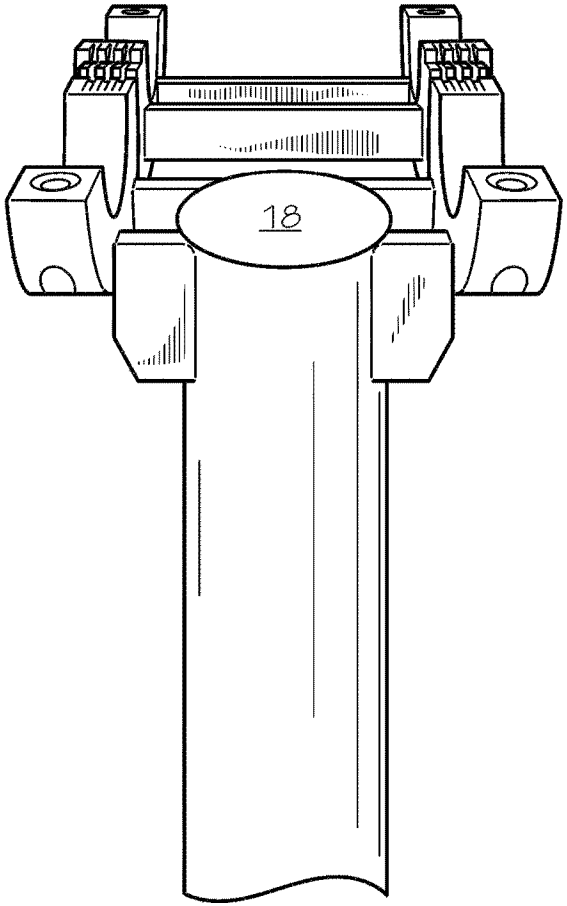

Referring to FIGS. 1-6, one embodiment of the adjustable sledgehammer workout apparatus 10 of the present invention may include a handle 12, a pair of supporting brackets 14 connected to an upper portion of the handle 12, and a clamping assembly 16 connected to the supporting brackets 14. The handle 12 may be 3 feet long but may vary in length in other embodiments. The handle 12 may be manufactured out of steel or any other material suitable for supporting the loads applied to the handle 12. The handle 12 may be hollow and may include end caps 18 (FIG. 4).

Figure 3:
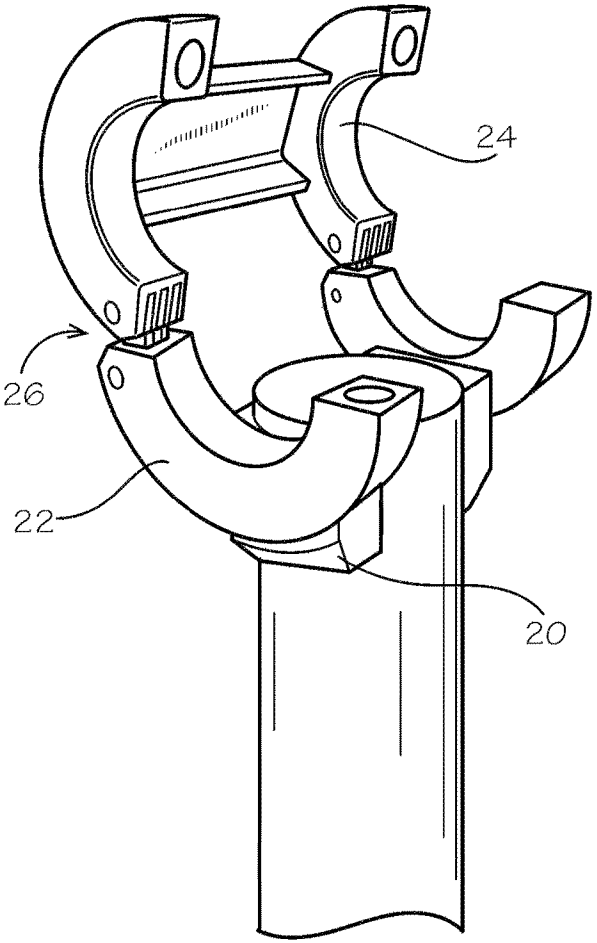
Figure 6:
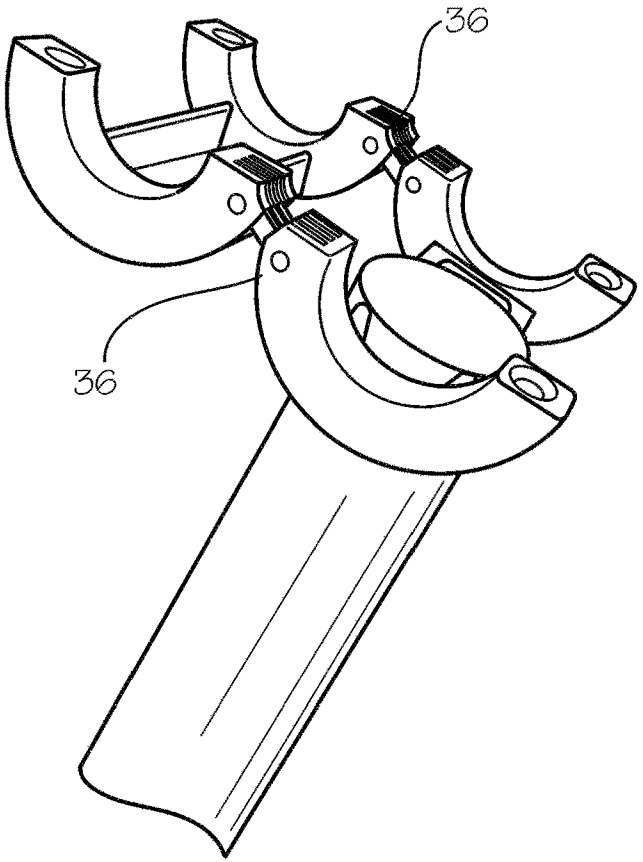
Figure 5:
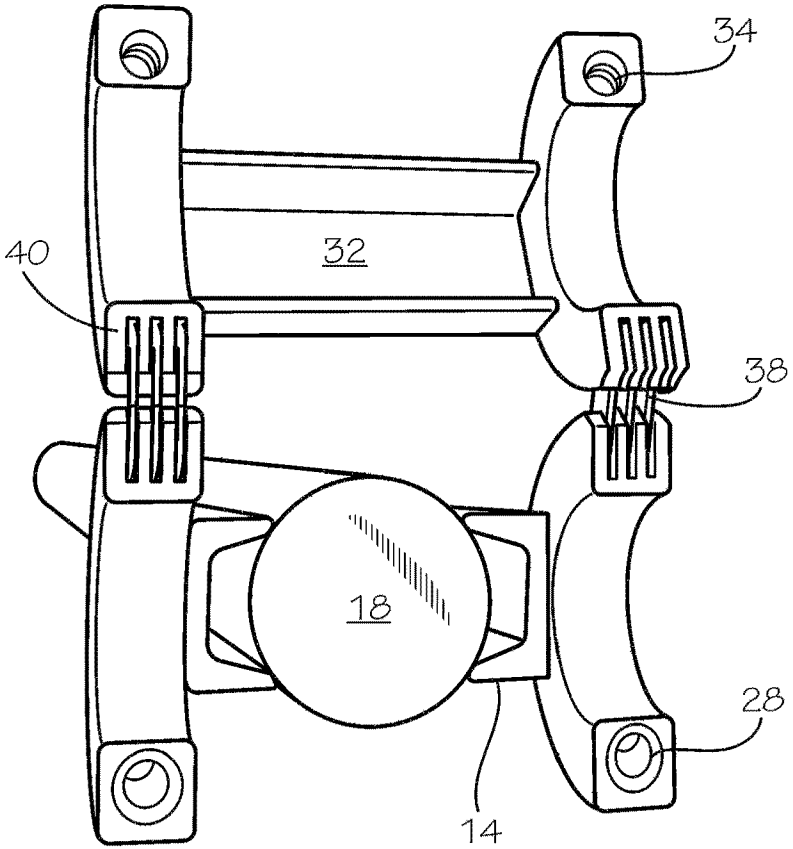

The supporting brackets 14 may be welded to the upper portion of the handle 12 and may be rectangular in shape with beveled or rounded edges 20 (FIG. 3). The supporting brackets 14 may also be manufactured out of steel or another suitable material. The supporting brackets 14 may be u-shaped as shown in FIG. 5 or solid blocks of material.

Figure 7:
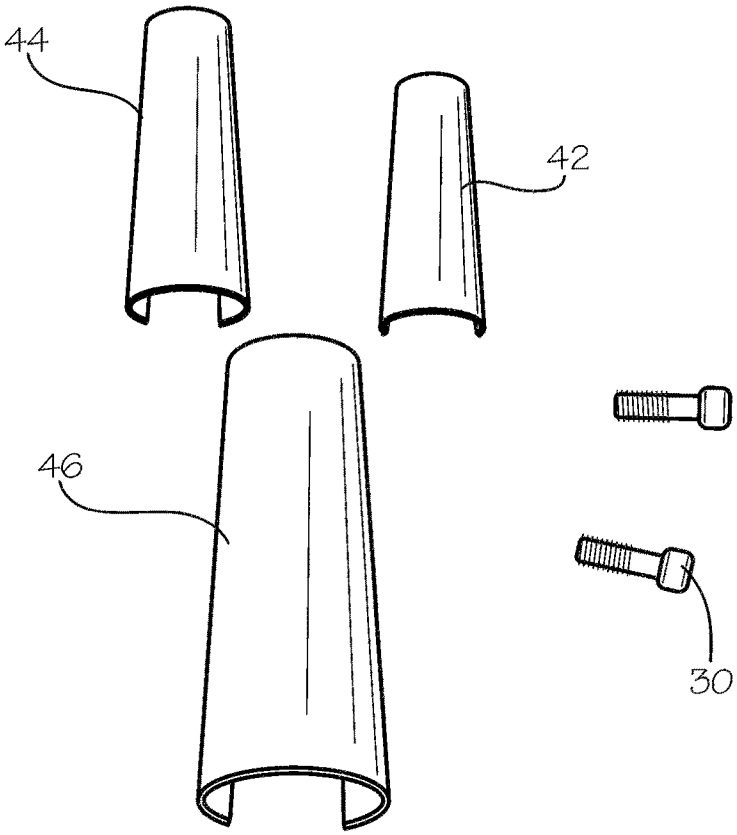
FIG. 7 is a perspective view showing another embodiment rubber pads and threaded bolts used with the present invention.

The clamping assembly 16 (FIG. 3) may include a pair of lower c-shaped portions 22 connected to a pair of upper c-shaped portion 24 using a hinge assembly 26, all of which may be manufactured out of steel or another suitable material. The clamping assembly 16 may be welded to the supporting brackets 14. The lower c-shaped portions 22 may include threaded openings 28 (FIG. 5) for receiving threaded bolts 30 (FIG. 7). The threaded openings 28 may extend through the lower c-shaped portions 22.

The upper c-shaped portions 24 may be connected together using an elongated, u-shaped support 32, which may be welded to the upper c-shaped portions 24. The upper c-shaped portions 24 may include threaded openings 34 for receiving the threaded bolts 30. The threaded openings 34 may extend through the upper c-shaped portions 24.

The hinge assembly 26 may include a pair of hinge pins 36 (FIG. 6) disposed in the upper and lower c-shaped portions, 24 and 22, and three hinge arms 38 (FIG. 5) connected to the upper and lower c-shaped portions, 24 and 22, using the hinge pins 36. The upper and lower c-shaped portions, 24 and 22, may include notches 40 and the hinge arms 38 may be disposed in the notches 40. The hinge assembly 26 may allow the upper c-shaped portion 24 to pivot up, back, and down with respect to the lower c-shaped portion 22.

The apparatus 10 may include different sized rubber pads, 42, 44, and 46, (FIG. 7) which may be wrapped around dumbbells before they are placed in the clamping assembly 16.

The workout apparatus 10 may be used by removing threaded bolts 30 (which may be hex bolts), lifting the upper c-shaped portion 24 up (FIG. 3), placing a dumbbell in the lower c-shaped portion 22 (optionally wrapping the dumbbell with one or more rubber pads to ensure the dumbbell fits securely in the clamping assembly 16), closing the upper c-shaped portion 24 so that the threaded openings 28 and 34 are aligned, and then securing the upper and lower c-shaped portions, 24 and 22, together using the threaded bolts 30. A user can then exercise by swinging the workout apparatus 10 like a sledgehammer against a large tire.

Figure 8:
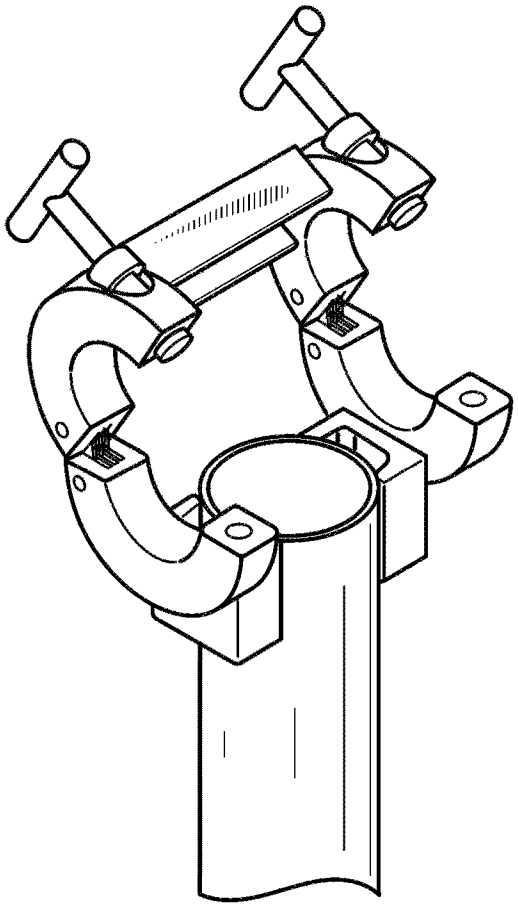
FIGS. 8-9 are perspective views showing another embodiment of the present invention.
Figure 9:
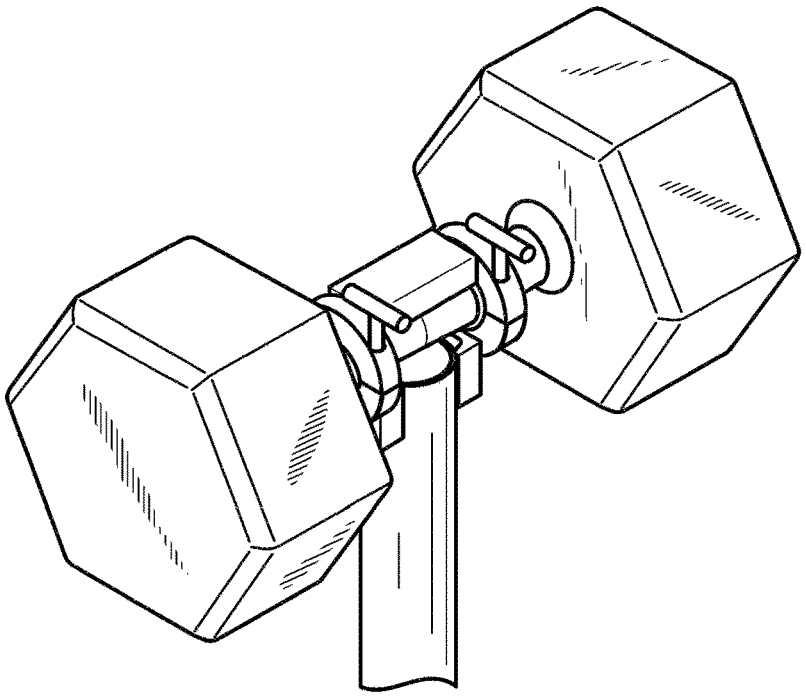
Figure 10:
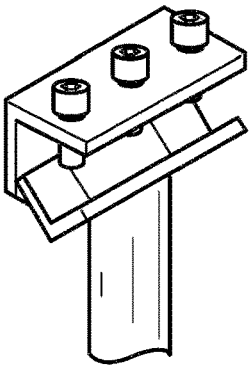
FIGS. 10-19 are perspective views showing additional embodiments of the present invention.
Figure 11:
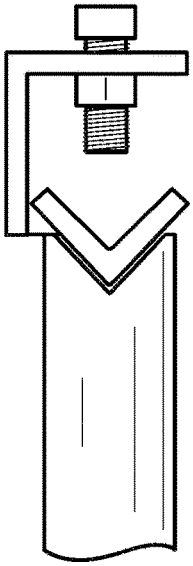
Figure 14:
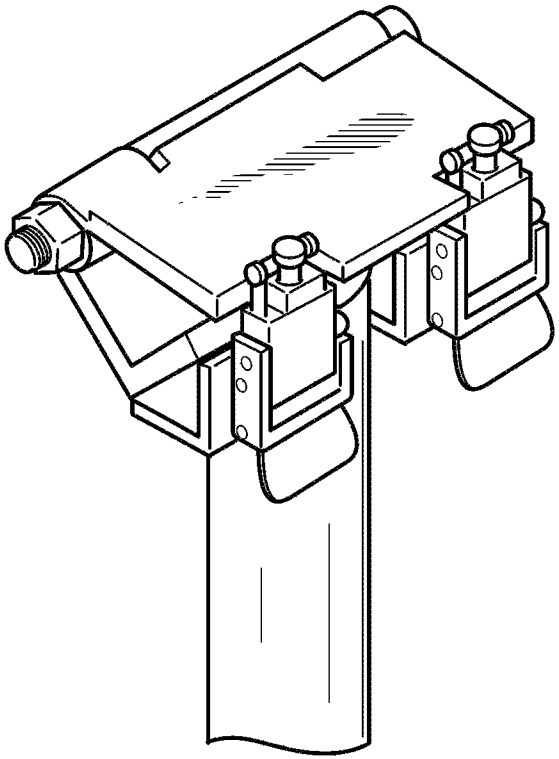
Figure 13:
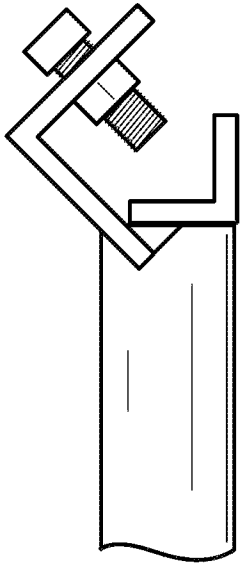
Figure 12:
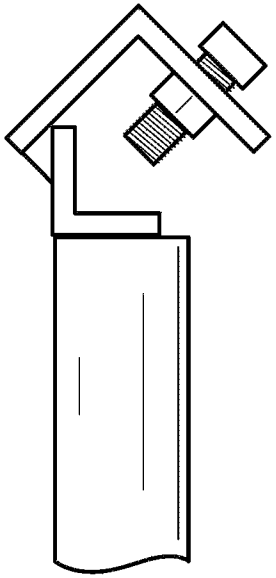
Figure 15:
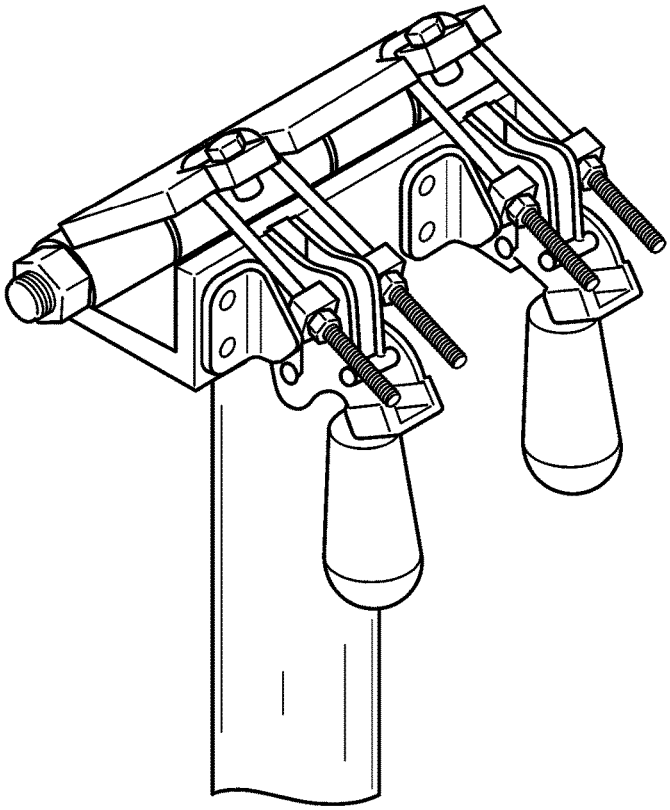
Figure 16:
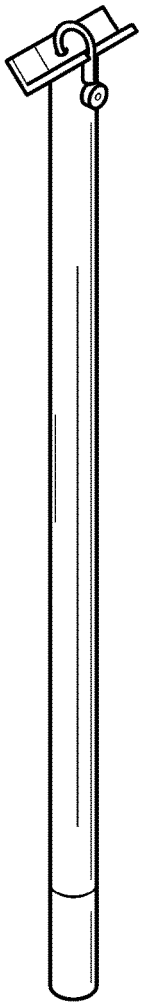
Figure 17:
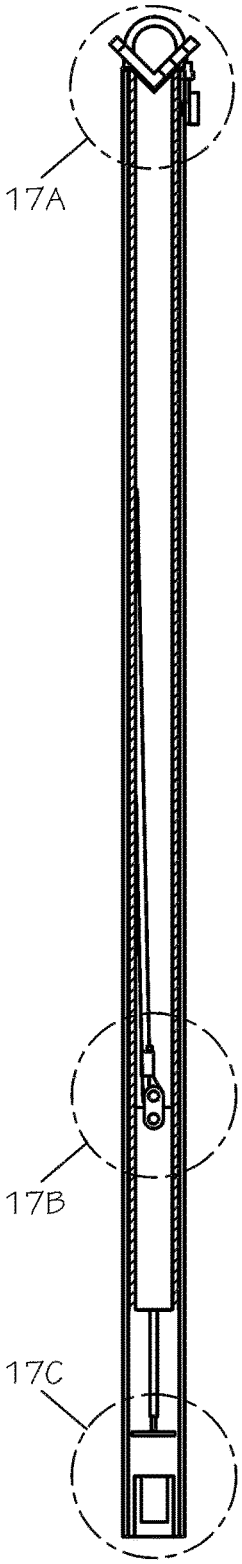
Figure 17A:
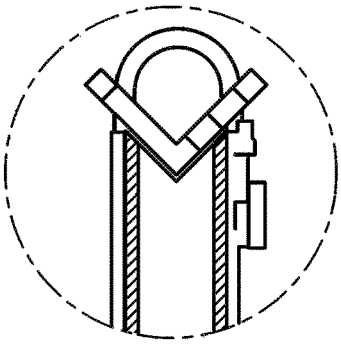
Figure 17B:
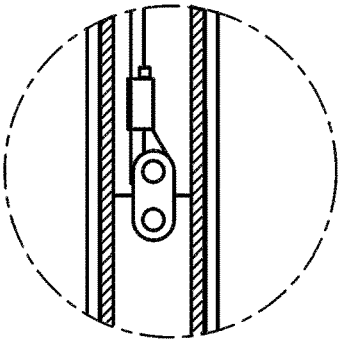
Figure 17C:
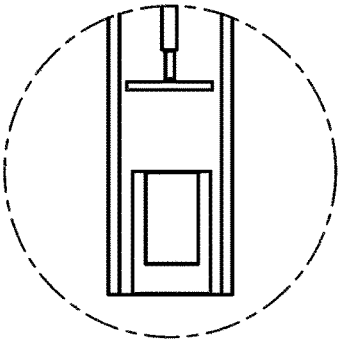
Figure 18:
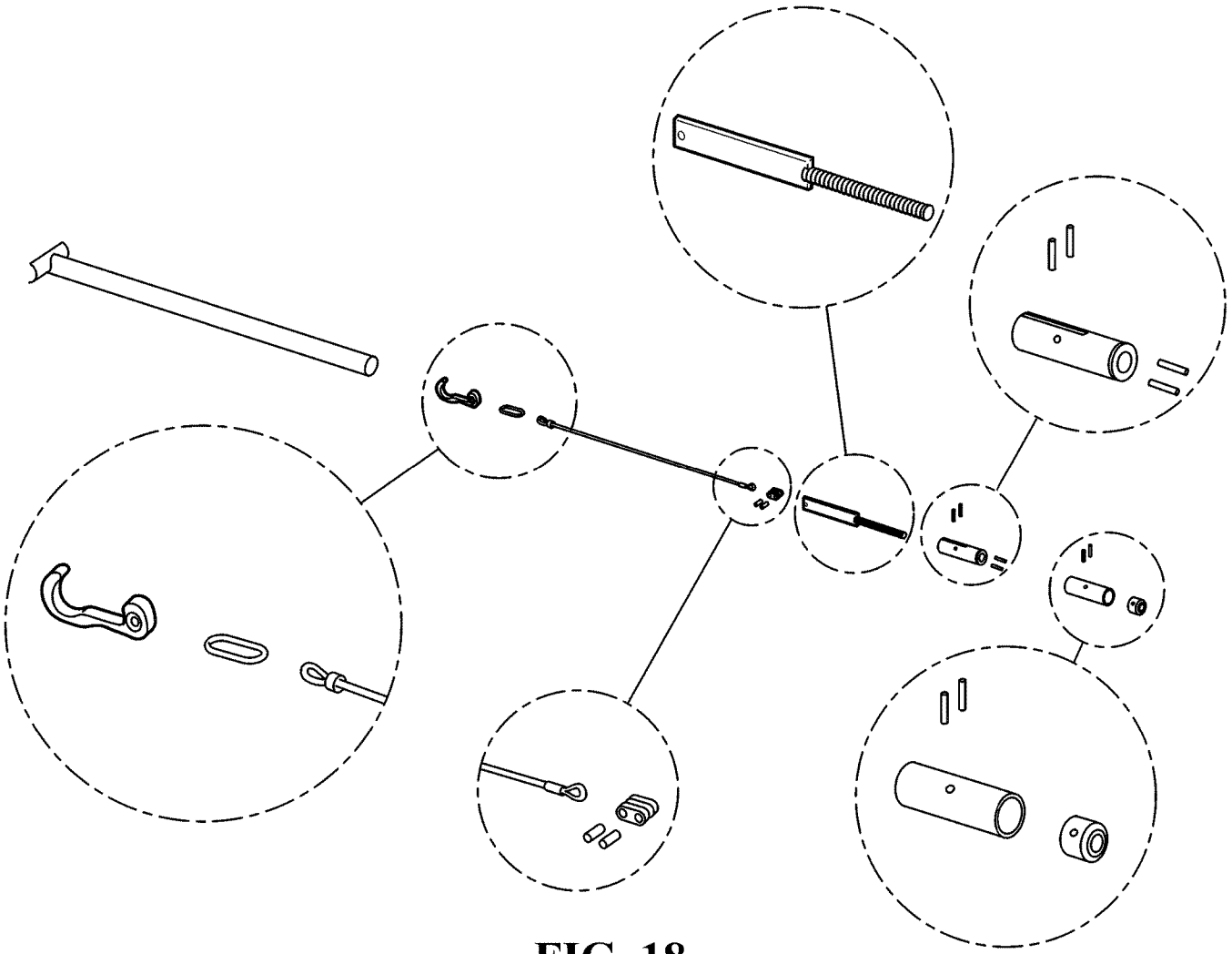
Figure 19:
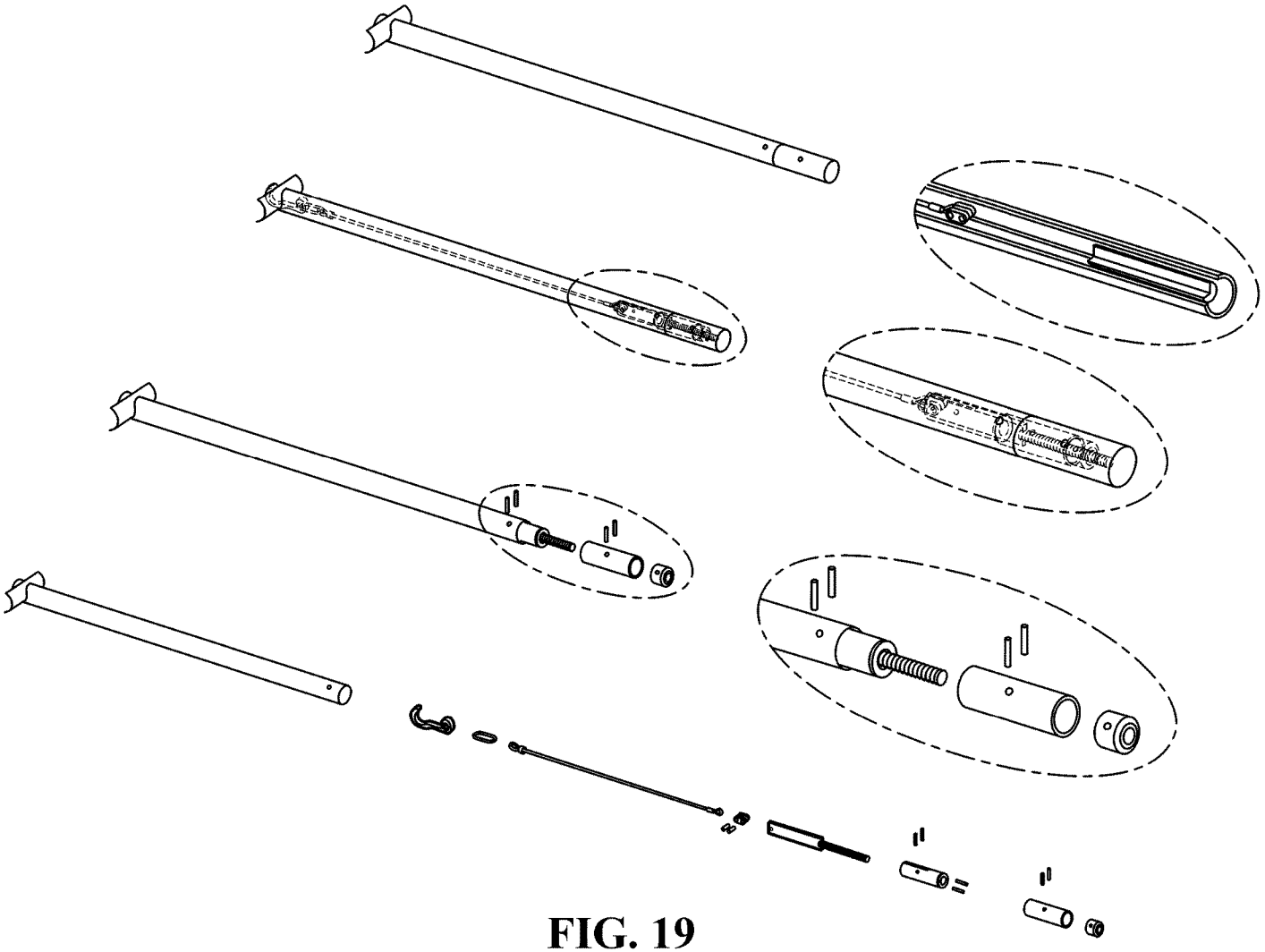

The workout apparatus 10 may include any one of a number of different clamping assemblies. For example, as shown in FIGS. 8 and 9, the clamping assembly 16 may be replaced with clamping assembly 48, which is identical to clamping assembly 16 expect that the threaded bolts 30 have been replaced with tightening fasteners 50. In FIGS. 10-13, clamping assembly 16 has been replaced with clamping assembly 52, which may include v-shaped lower portion 54, L-shaped upper portion 56, and multiple jack screw fasteners 58. Lower portion 54 and upper portion 56 may be welded to the upper portion of handle 12. The upper portion of the handle 12 may be modified to include a v-shaped notch 60 for receiving the v-shaped lower portion 54 in one embodiment (FIG. 11). A similar version without v-shaped notch 60 is shown in FIG. 12. The upper portion of handle 12 may also been modified to include smaller v-shaped notch 62 as shown in FIG. 13. The clamping assembly 16 may be replaced with draw clamp 64 as shown in FIG. 14 or toggle clamp 66 as shown in FIG. 15.

FIGS. 16-19 show a cable pull version of the workout apparatus 10. In this embodiment, the handle 12 includes a rotatable lower portion 68, a cable 70 disposed in the handle 12, a tension rod 72 having one end connected to the cable 70 and an opposite threaded end 74 connected the rotatable lower portion 68. When the rotatable lower portion 68 is rotated in one direction, the tension rod 72 and the cable 70 are pulled in one direction and, when the rotatable lower portion 68 is rotated in an opposite direction, the tension rod 72 and cable 70 are pulled in the opposite direction.

Thus, although there have been described particular embodiments of the present invention of a new and useful ADJUSTABLE SLEDGEHAMMER WORKOUT APPARATUS, it is not intended that such references be construed as limitations upon the scope of this invention.

What is claimed is:

1. An adjustable sledgehammer workout apparatus for receiving a dumbbell, the apparatus comprising:

a handle having a first end;

a clamping assembly including:

a first side clamp having a first upper portion and a first lower portion, the first lower portion mounted to a first side location of the first end of the handle via a first lower bracket;

a second side clamp having a second upper portion and a second lower portion, the second lower portion mounted to a second opposite side location of the first end of the handle via a second lower bracket; and an upper brace connected between the first upper portion of the first side clamp and the second upper portion of the second side clamp;

wherein an upper portion of the clamping assembly comprises the first upper portion of the first side clamp and the second upper portion of the second side clamp;

wherein a lower portion of the clamping assembly comprises the first lower portion of the first side clamp and the second lower portion of the second side clamp; and wherein the clamping assembly is operable to releasably clamp the dumbell between the upper portion of the clamping assembly and the lower portion of the clamping assembly.

2. The apparatus of claim 1, wherein the upper portion of the clamping assembly is connected to the lower portion of the clamping assembly via a hinge assembly.

3. The apparatus of claim 1, further comprising a rubber pad positionable between the dumbbell and at least one of the upper portion or the lower portion of the clamping assembly.

4. The apparatus of claim 1, wherein the rubber pad is wrappable around the dumbbell such that when the dumbbell is clamped between the upper and lower portions of the clamping assembly, both the upper and lower portions of the clamping assembly are clamped against the rubber pad.

5. The apparatus of claim 1, further including a fastener disposed on the upper portion, the fastener operable to clamp the dumbbell between the upper portion and the lower portion of the clamping assembly.

6. The apparatus of claim 5, wherein the fastener extends through the upper portion of the clamping assembly and extends into the lower portion of the clamping assembly to clamp the upper and lower portions of the clamping assembly together.

7. The apparatus of claim 6, wherein:

the fastener is a threaded bolt;

the lower portion of the clamping assembly includes a threaded recess; and the fastener extends through the upper portion of the clamping assembly to threadingly engage the threaded recess in the lower portion of the clamping assembly to clamp the upper and lower portions of the clamping assembly together.

8. The apparatus of claim 5, wherein the fastener extends through the upper portion and is operable to clamp the dumbbell against the lower portion of the clamping assembly.

9. The apparatus of claim 5, wherein the fastener includes a fastener handle.

10. The apparatus of claim 1, wherein the first and second lower brackets are U-shaped.

11. The apparatus of claim 1, wherein the first side clamp includes a first hinged portion connecting the first lower portion to the first upper portion, and wherein the second side clamp includes a second hinged portion connecting the second lower portion to the second upper portion.

12. The apparatus of claim 1, further comprising:

a first fastener operable to clamp the first upper portion of the first side clamp to the first lower portion of the first side clamp; and a second fastener operable to clamp the second upper portion of the second side clamp to the second lower portion of the second side clamp.

13. The apparatus of claim 1, wherein the handle includes a steel pipe having a diameter of between about 1 inch and 1.5 inches and a length of between about 32 and 40 inches.

14. An adjustable sledgehammer workout apparatus for receiving a dumbbell, the dumbbell having a dumbbell handle and two weighted ends, the apparatus comprising:

an apparatus handle having a first end and a rotatable bottom portion;

a clamping assembly mounted to the first end of the apparatus handle, the clamping assembly operable to releasably clamp the dumbbell handle of the dumbbell within the clamping assembly, the clamping assembly further including:

a threaded tension rod disposed in the rotatable bottom portion of the apparatus handle; and a cable having one end connected to the threaded tension rod and another end extending out of and connected to the first end of the apparatus handle;

wherein the rotatable bottom portion of the apparatus handle is operable to move the threaded tension rod within the apparatus handle to selectively tension the cable.

15. The apparatus of claim 14, wherein the clamping assembly further includes an upper portion and a lower portion, the clamping assembly operable to releasably clamp the dumbbell handle between the upper portion and the lower portion of the clamping assembly.

16. An adjustable sledgehammer workout apparatus for receiving a dumbbell, the dumbbell having a dumbbell handle and two weighted ends, the apparatus comprising:

an apparatus handle having a first end;

a clamping assembly including:

a first side clamp having a first lower portion and a first upper portion;

a second side clamp having a second lower portion and a second upper portion, the first and second lower portions mounted on opposite sides of the first end of the apparatus handle, the first lower portion mounted to a first side location of the first end of the apparatus handle, the second lower portion mounted to a second opposite side location of the first end of the apparatus handle;

wherein the clamping assembly is operable to releasably clamp the dumbbell between the first upper and lower portions of the first side clamp and between the second upper and lower portions of the second side clamp with the dumbbell handle positioned between the first and second side clamps.

17. The apparatus of claim 16, wherein the first lower portion and the first upper portion are pivotally connected together, and the second lower portion and the second upper portion are pivotally connected together.

18. The apparatus of claim 16, further comprising an upper brace connected between the first and second upper portions.

* * * * *